US011785983B2

(12) United States Patent
Banks et al.

(10) Patent No.: US 11,785,983 B2
(45) Date of Patent: Oct. 17, 2023

(54) HIGH TOTAL DENIER CELLULOSE ACETATE TOW FOR HOLLOW FILTERS AND NON-WRAPPED FILTERS

(71) Applicant: ACETATE INTERNATIONAL LLC, Irving, TX (US)

(72) Inventors: Austin P. Banks, Blacksburg, VA (US); Christopher M. Bundren, Blacksburg, VA (US); Melissa Tsai, Irving, TX (US)

(73) Assignee: Acetate International LLC, Irving, TX (US)

( * ) Notice: Subject to any disclaimer, the term of this patent is extended or adjusted under 35 U.S.C. 154(b) by 240 days.

(21) Appl. No.: 16/968,787

(22) PCT Filed: Feb. 21, 2019

(86) PCT No.: PCT/US2019/018974
§ 371 (c)(1),
(2) Date: Aug. 10, 2020

(87) PCT Pub. No.: WO2019/165084
PCT Pub. Date: Aug. 29, 2019

(65) Prior Publication Data

US 2020/0397039 A1 Dec. 24, 2020

Related U.S. Application Data

(60) Provisional application No. 62/634,483, filed on Feb. 23, 2018.

(51) Int. Cl.
*A24D 3/10* (2006.01)
*A24D 3/17* (2020.01)
(Continued)

(52) U.S. Cl.
CPC ..... *A24D 3/10* (2013.01); *A24D 3/0279* (2013.01); *A24D 3/04* (2013.01); *A24D 3/063* (2013.01); *A24D 3/17* (2020.01)

(58) Field of Classification Search
CPC ..... A24D 3/10; A24D 3/17; A24D 3/0279; A24D 3/04; A24D 3/063
(Continued)

(56) References Cited

U.S. PATENT DOCUMENTS 4,947,874 A 8/1990 Brooks et al.
5,225,277 A * 7/1993 Takegawa et al. ..... D02G 3/00 428/369
(Continued)

FOREIGN PATENT DOCUMENTS

CN 105188430 A 12/2015
JP H02-124082 A 5/1990
(Continued)

OTHER PUBLICATIONS

First Office Action for Chinese Application No. 201980014604.2 dated Mar. 1, 2022, all pages.
(Continued)

*Primary Examiner* — Michael J Felton
*Assistant Examiner* — Ronnie Kirby Jordan
(74) *Attorney, Agent, or Firm* — Kilpatrick Townsend & Stockton LLP

(57) ABSTRACT

Disclosed are cellulose acetate tows, bales, and filter rods having at least 3 denier per filament and at least 50,000 total denier, or at least 6 denier per filament and at least 40,000 total denier, for use as hollow filters, non-wrapped filters, or combinations thereof, in smoking devices and aerosol-generating devices, such as an electrically heated cigarette. The cellulose acetate tow may comprise at least 3-6 denier per filament and may have a total denier of at least 50,000 to 100,000. The cellulose acetate tow comprises at least 6-12 denier per filament and may have a total denier of at least 40,000 to 90,000. The hollow filter may comprise a non-wrapped cellulose acetate hollow filter.

16 Claims, 1 Drawing Sheet

(51) Int. Cl.
*A24D 3/02* (2006.01)
*A24D 3/04* (2006.01)
*A24D 3/06* (2006.01)

(58) Field of Classification Search
USPC ..... 131/345
See application file for complete search history.

(56) References Cited

U.S. PATENT DOCUMENTS

| | | | | |
|---|---|---|---|---|
| 5,947,126 | A | 9/1999 | Wilson et al. | |
| 2014/0261487 | A1* | 9/2014 | Chapman et al. | A24F 47/008 131/328 |
| 2017/0099871 | A1 | 4/2017 | Karakane et al. | |

FOREIGN PATENT DOCUMENTS

| | | | |
|---|---|---|---|
| JP | H1142074 | A | 2/1999 |
| JP | 2011-032629 | A | 2/2011 |
| JP | 2015-531234 | A | 11/2015 |
| JP | 2016512033 | A | 4/2016 |
| JP | 2016-514473 | A | 5/2016 |
| WO | 2006/007020 | A1 | 1/2006 |
| WO | 2014053829 | A1 | 4/2014 |
| WO | 2014/155340 | A1 | 10/2014 |
| WO | 2014159982 | A1 | 10/2014 |
| WO | 2015194007 | A1 | 12/2015 |
| WO | 2017/036586 | A1 | 3/2017 |
| WO | 2017/148773 | A1 | 9/2017 |
| WO | 2017148773 | A1 | 9/2017 |
| WO | WO 2014/148773 | A1 * | 9/2017 ..... A24D 3/02 |

OTHER PUBLICATIONS

Office Action from Eurasian Patent Office for Appln No. 202092009 dated Mar. 24, 2021, 4 pages.
International Search Report received in the corresponding International Application No. PCT/US2015/018974, dated May 3, 2019, 2 pp.
Notification of Second Office Action for CN Appln No. 201980014604.2 dated Jul. 12, 2022, all pages.
Notification of Reasons for Rejection for Japanese Patent App. No. 2020-544484 dated Dec. 5, 2022, all pages.
Rejection Decision for CN No. 201980014604.2 dated Jan. 9, 2023, all pages.
Notification of Third Office Action for Chinese Appln No. 201980014604.2 dated May 7, 2023, all pages.
Final Office Action for Japanese Appln No. 2020-544484 dated Mar. 29, 2023, all pages.

* cited by examiner

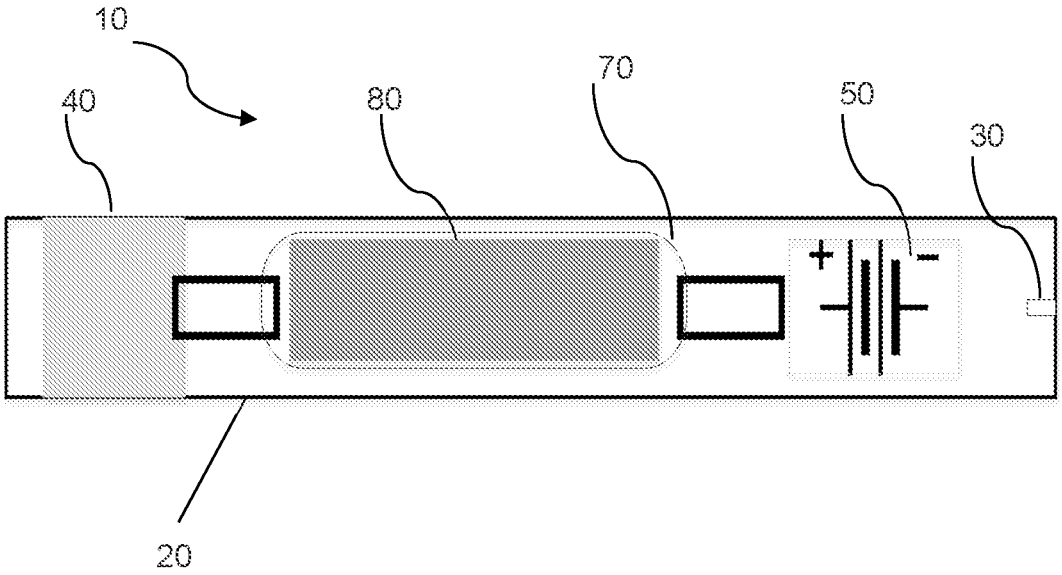
10
40
80
70
50
30
+
−
20

HIGH TOTAL DENIER CELLULOSE ACETATE TOW FOR HOLLOW FILTERS AND NON-WRAPPED FILTERS

CROSS-REFERENCE TO RELATED APPLICATION

This application is the U.S. National Stage application of International Application No. PCT/US2019/018974, filed Feb. 21, 2019, which claims priority to U.S. Provisional Patent Application No. 62/634,483, filed Feb. 23, 2018. The entirety of each of these applications are incorporated herein by reference.

PRIORITY CLAIM

This patent application claims priority to U.S. Provisional Patent Application No. 62/634,483, filed Feb. 23, 2018, the disclosure of this application is incorporated herein by reference in its entirety.

FIELD OF THE INVENTION

The present disclosure relates generally to high total denier cellulose acetate tow, and hollow smoking device filters, non-wrapped filters, and combinations thereof, produced therefrom. In particular, the present disclosure relates to cellulose acetate tow comprising at least 3 denier per filament and at least 50,000 total denier, or at least 6 denier per filament and at least 40,000 total denier, included in a hollow rod or hollow filter, non-wrapped filters, and combinations thereof, for use in a smoking device or aerosol-generating device.

BACKGROUND OF THE INVENTION

Cellulose esters, such as cellulose acetate, are known for their use in traditional cigarette filters and other smoking articles. Many factors affect cigarette filter production and performance. The cellulose ester, supplied to filter manufacturers as cellulose ester tow, is manufactured to meet certain properties required for cigarette filters, such as a firmness, pressure drop, pressure drop variability, fly, and openability, with a goal being a cigarette with acceptable draw resistance. Methods of making cellulose ester tow continue to be refined to improve the properties of the tow for use in cigarette filters.

The draw resistance of smoking articles, e.g., cigarettes or aerosol-generating devices, is a major determinant of the draw characteristic(s) of the cigarette which are experienced by a smoker. In cellulose acetate filters, draw characteristics may depend on several factors including the cellulose acetate filament characteristics, the amount of cellulose acetate filaments, and the concentration of additives incorporated in said filaments. One measure of draw characteristics is the encapsulated pressure drop. As used herein, the term "encapsulated pressure drop" or "EPD" refers to the static pressure difference between the two ends of a specimen when it is traversed by an air flow under steady conditions when the volume flow is 17.5 ml/sec at the output end when the specimen is completely encapsulated in a measuring device so that no air can pass through the wrapping. EPD has been measured herein under the CORESTA ("Cooperation Centre for Scientific Research Relative to Tobacco") Recommended Method No. 41, dated June 2007. Higher EPD values translate to the smoker having to draw on a smoking device with greater force.

Currently, the desired draw resistance for cellulose acetate filters is achieved by forming filters from tow bands having low denier per filament (dpf) and medium total denier (less than 40,000 total denier), i.e., many filaments with each filament having a small cross-sectional area. The small cross-sectional area is believed to provide high surface area, which translates to higher filtering efficacy. These low dpf, medium total denier tow bands, however, have issues when responding to markets that are trending to smaller-diameter smoking articles and jurisdictions having increasing regulations that require increased filter efficacy. First, producing smaller diameter smoking articles with these known tow bands effectively condenses the filaments into a smaller space, which increases the EPD and changes the draw characteristics as a result. Second, increasing the filter efficacy of the medium total denier of these tow bands would require more surface area, e.g., more filaments, which would exacerbated the higher EPD issue. Additionally, the inclusion of particles that actively remove smoke components from a smoke screen (e.g., carbon) fill the voids of the filters leading to higher EPDs. The fiber strength and hardness of these filters are also compromised.

In other cases, the desired draw resistance for cellulose acetate filters is achieved by forming filters from tow bands having high dpf and low total denier. By utilizing low total deniers, it may be useful for producing smoking device filters with low EPD and circumference combinations. The high dpf and low total denier provide smaller-diameter smoking articles and increased filter efficacy. The strength and hardness of these filters, however, are compromised at lower total deniers. Additionally, each of the aforementioned filters require two bales to form the filters resulting in increased rod complexity and variability.

Therefore, among other things, a need exists for cellulose acetate tow having higher total denier, for forming a non-wrapped filter rod, a hollow filter rod, and filters therefrom, in a smoking device and/or aerosol-generating device with desired draw characteristics and strength/hardness.

SUMMARY OF THE INVENTION

In some embodiments, the present disclosure is directed to a hollow filter rod comprising a cellulose acetate tow having at least 3 denier per filament and at least 50,000 total denier or at least 6 denier per filament and at least 40,000 total denier. The hollow filter rod may comprise a non-wrapped cellulose acetate filter rod. In some aspects, the hollow filter rod comprises a cellulose acetate tow having from 3 to 6 denier per filament and from 50,000 to 100,000 total denier. In some aspects, the hollow filter rod comprises a cellulose acetate tow having at least 6 denier per filament and at least 50,000 total denier. In some aspects, the hollow filter rod comprises a cellulose acetate tow having from 6 to 12 denier per filament and from 40,000 to 90,000 total denier. In some aspects, the hollow filter rod comprises a cellulose acetate tow having at least 8 denier per filament and at least 40,000 total denier. The filaments of the cellulose acetate tow may have a cross-sectional shape selected from the group comprising circular, substantially circular, crenulated, ovular, substantially ovular, polygonal, substantially polygonal, dog-bone, "Y," "X," "K," "C," multi-lobe, and any combination thereof. The hollow filter rod may have an encapsulated pressure drop of less than 4.5 mm water/mm length.

In some embodiments, the present disclosure is directed to a smoking device comprising a hollow filter. The hollow filter may comprise a cellulose acetate tow comprising at least 3 denier per filament and at least 50,000 total denier or at least 6 denier per filament and at least 40,000 total denier. In some aspects, the cellulose acetate tow has from 3 to 6 denier per filament and from 50,000 to 100,000 total denier. In some aspects, the cellulose acetate tow has at least 6 denier per filament and at least 50,000 total denier. In some aspects, the cellulose acetate tow has from 6 to 12 denier per filament and from 40,000 to 90,000 total denier. In some aspects, the cellulose acetate tow has at least 8 denier per filament and at least 40,000 total denier. The hollow-filter may comprise a non-wrapped cellulose acetate filter. The hollow filter rod may have an encapsulated pressure drop of less than 4.5 mm water/mm length.

In some embodiments, the present disclosure is directed to an aerosol-generating device comprising a hollow filter. The hollow filter comprises a cellulose acetate tow having at least 3 denier per filament and at least 50,000 total denier or at least 6 denier per filament and at least 40,000 total denier. In some aspects, the cellulose acetate tow comprises from 3 to 6 denier per filament and from 50,000 to 100,000 total denier. In some aspects, the cellulose acetate tow comprises at least 6 denier per filament and at least 50,000 total denier. In some aspects, the cellulose acetate tow comprises from 6 to 12 denier per filament and from 40,000 to 90,000 total denier. In some aspects, the cellulose acetate tow comprises at least 8 denier per filament and at least 40,000 total denier. The hollow filter may comprise a non-wrapped cellulose acetate filter. The hollow filter may have an encapsulated pressure drop of less than 4.5 mm water/mm length.

In some embodiments, the present disclosure is related to a method of forming a hollow filter rod. The method includes the steps of: forming a bale from a tow band having at least 3 denier per filament and at least 50,000 total denier or at least 6 denier per filament and at least 40,000 total denier, the tow band comprising a plurality of cellulose acetate filaments; debaling and opening the tow band to form a filter tow; and forming a hollow filter rod from the filter tow. The hollow filter rod is formed from a single bale of tow band. The hollow filter rod has an encapsulated pressure drop of less than 4.5 mm water/mm length. The hollow filter may comprise a non-wrapped cellulose acetate filter.

BRIEF DESCRIPTION OF THE DRAWINGS

The present invention will be better understood in view of the appended non-limiting figure, in which:

FIG. 1 shows a cross-sectional view of an aerosol-generating article in accordance with embodiments of the present invention.

DETAILED DESCRIPTION OF THE INVENTION

Introduction

The present disclosure is directed to high total denier cellulose acetate tow bands, hollow filter rods, non-wrapped cellulose acetate filter rods, and smoking device filters produced therefrom. In particular, the present disclosure provides cellulose acetate tow bands with a high total denier, formed from a single bale, which may be useful for producing hollow smoking device filters with previously unrealized encapsulated pressure drop (EPD) and strong filter integrity. The high total denier tow bands produce hollow filters with sufficient strength and hardness. The present disclosure also provides cellulose acetate tow bands with a high total denier, formed from a single bale, to form non-wrapped cellulose acetate filters. The high total denier of the tow also translates to higher filtering efficacy, while advantageously maintaining a low EPD. In some embodiments, the hollow filters made from the high total denier cellulose acetate tow bands may be non-wrapped cellulose acetate filters.

Further, the present disclosure provides production steps and parameters that yield high total denier cellulose acetate tow bands that may integrate substantially seamlessly into current manufacturing processes. The high total denier tow band may be produced from a single tow bale to simplify the method of producing high total denier tow band and produces a filter rod of increased quality. In conventional processes, two or more bales of two bands are combined to produce a tow band having a standard denier per filament (dpf) and standard total denier tow band resulting in rod complexity and variability. By using a single bale comprising filaments having high total denier, the present process can produce high total denier tow bands of improved qualify with improved manufacturing efficiency. In some aspects, the single bale of high total denier tow bands produce high total denier hollow filter rods to form a hollow filter used in smoking devices, e.g., conventional cigarettes or aerosol-generating devices. In some aspects, the single bale of high total denier tow band produces high total denier non-wrapped filter rods that form non-wrapped cellulose acetate filters.

Beneficially, by using a cellulose acetate tow having at least 3 denier per filament and at least 50,000 total denier, or cellulose acetate tow having at least 6 denier per filament and at least 40,000 total denier, the pressure drop values of the filter are decreased while maintaining high filter strength, leading to improvements in draw while maintaining the desired hardness of the filter. While conventional cigarette filters typically use cellulose acetate tow having low dpf (e.g., up to 3.5 dpf) and medium total denier (e.g., up to 40,000 total denier), it has surprisingly and unexpectedly been found that cellulose acetate tows having high total denier may be used in the hollow filter of a smoking device and/or the aerosol-generating device. When used in the hollow filter or non-wrapped filter, the cellulose acetate tow having at least 3 denier per filament and at least 50,000 total denier, or cellulose acetate tow having at least 6 denier per filament and at least 40,000 total denier, is able to achieve a low encapsulated pressure drop, which improves the draw characteristics of the cigarette, while maintaining strength and hardness of the filter. It was also found that using a non-wrapped cellulose acetate filter beneficially provided improved smoking characteristics.

Additionally, it was found that high total denier cellulose acetate tow items advantageously have an improved surface area index, e.g., ratio of cross-sectional surface area to area of an equivalent circle. In particular, hollow and/or non-wrapped high total denier cellulose acetate items have a greater surface area index compared to low or medium total denier cellulose acetate items.

Cellulose Acetate

In some embodiments, the present disclosure relates to a cellulose acetate tow processed into filter rods for use, for example, as hollow filters or non-wrapped filters in smoking devices and aerosol-generating devices, e.g., as the mouthpiece or as a filter in an aerosol-generating device. In some aspects, cellulose acetate refers to cellulose diacetate. In some aspects, the cellulose acetate has a degree of substitution from 2 to 2.6.

Cellulose acetate may be prepared by known processes, including those disclosed in U.S. Pat. No. 2,740,775 and in U.S. Publication No. 2013/0096297, the entireties of which are incorporated herein by reference. Typically, acetylated cellulose is prepared by reacting cellulose with an acetylating agent in the presence of a suitable acidic catalyst and then de-esterifying.

Bales and Methods of Producing Bales

In some embodiments of the present disclosure, a bale of crimped tow band having a high total denier may be used to form hollow filter rods, non-wrapped filter rods, filter sections, or any combination thereof that are suitable for use with smoking devices, e.g., conventional cigarettes or aerosol-generating devices. Examples of high total denier tow bands may be those according to the various embodiments disclosed herein. In some embodiments, a bale of crimped tow band having about 3 dpf or greater and about 50,000 total denier or more may be used in producing filter rods, filter sections, or any combination thereof. In other embodiments, a bale of crimped tow band having about 6 dpf or greater and about 40,000 total denier or more may be used in producing filter rods, filter sections, or any combination thereof. The crimped tow band may comprise a plurality of cellulose acetate filaments. In some embodiments, a bale may comprise more than one tow band.

In some embodiments, a bale of crimped tow band comprises at least 3 dpf or greater and at least 50,000 total denier or greater. In some embodiments, a bale of crimped tow band comprises from 3 dpf to 6 dpf and from 50,000 total denier to 100,000 total denier. In some embodiments, a bale of crimped tow band comprises from 6 dpf to 12 dpf and from 40,000 total denier to 90,000 total denier. The bale of crimped tow band may be used to produce hollow filter rods, hollow filter sections, non-wrapped filter rods, non-wrapped filter sections, or any combination thereof. In some embodiments, the crimped tow band comprises a plurality of cellulose acetate filaments.

Generally, the production of a bale of tow bands may involve spinning filaments from a dope, forming a tow band from the filaments, crimping the tow band, and baling the crimped tow band. Within said production, optional steps may include, but not be limited to, warming the filaments after spinning, applying a finish or additive to the filaments and/or tow band prior to crimping, and conditioning the crimped tow band. The parameters of at least these steps are important for producing bales capable of producing smoking device filters described herein. It should be noted that bales may vary in size and shape as needed for further processing.

In some embodiments, filaments for use in the present disclosure may be about 3 denier per filament (dpf) or greater. In some embodiments, filaments for use in the present disclosure may be about 6 denier per filament or greater. In some embodiments, filaments for use in the present disclosure may be about 9 denier per filament or greater. In some embodiments, the filaments may range from 2 dpf to 12 dpf, e.g., from 3 dpf to 12 dpf, from 3 dpf to 6 dpf, from 4 dpf to 5 dpf, from 6 dpf to 12 dpf, from 7 dpf to 10 dpf, from 6 dpf to 9 dpf, or from 7 dpf to 8 dpf. In terms of lower limits, the filaments may be greater than 3 dpf, e.g., greater than 5 dpf, greater than 7 dpf, or greater than 9 dpf. In terms of upper limits, the filaments may be less than 12 dpf, e.g., less than 10 dpf, less than 8 dpf, or less than 6 dpf.

The filaments for use in the present disclosure may have any suitable cross-sectional shape, including, but not limited to, circular, substantially circular, crenulated, ovular, substantially ovular, polygonal, substantially polygonal, dogbone, "Y," "X," "K," "C," multi-lobe, and any hybrid thereof. As used herein, the term "multi-lobe" refers to a cross-sectional shape having a point (not necessarily in the center of the cross-section) from which at least two lobes extend (not necessarily evenly spaced or evenly sized).

The filaments for use in the present disclosure may be produced by any method known to one skilled in the art. In some embodiments, filaments may be produced by spinning a dope through a spinneret. As used herein, the term "dope" refers to a cellulose acetate solution and/or suspension from which filaments are produced. In some embodiments, a dope may comprise cellulose acetate and solvents. In some embodiments, a dope for use in conjunction with the present disclosure may comprise cellulose acetate, solvents, and additives. It should be noted that additives are further detailed herein.

Some embodiments of the present disclosure may involve treating filaments to achieve surface functionality on the filaments. In some embodiments, filaments may comprise a surface functionality including, but not limited to, biodegradability sites (e.g., defect sites to increase surface area to enhance biodegradability), chemical handles (e.g., carboxylic acid groups for subsequent functionalization), active particle binding sites (e.g., sulfide sites binding gold particles or chelating groups for binding iron oxide particles), sulfur moieties, or any combination thereof. One skilled in the art should understand the plurality of methods and mechanisms to achieve surface functionalities. Some embodiments may involve dipping, spraying, ionizing, functionalizing, acidizing, hydrolyzing, exposing to a plasma, exposing to an ionized gas, or any combination thereof to achieve surface functionalities. Suitable chemicals to impart a surface functionality may be any chemical or collection of chemicals capable of reacting with cellulose acetate including, but not limited to, acids (e.g., sulfuric acid, nitric acid, acetic acid, hydrofluoric acid, hydrochloric acid, and the like), reducing agents (e.g., $LiAlH_4$, $NaBH_4$, $H_2$/Pt, and the like), Grignard reagents (e.g., $CH_3MgBr$, and the like), trans-esterification reagent, amines (e.g., R—$NH_3$ like $CH_3NH_3$), or any combination thereof. Exposure to plasmas and/or ionized gases may react with the surface, produce defects in the surface, or any combination thereof. Said defects may increase the surface area of the filaments which may yield higher loading and/or higher filtration efficacy in the final filter products.

In some embodiments, the present disclosure may include forming tow bands from a plurality of filaments, e.g., cellulose acetate filaments. In some embodiments, a tow band may include about 40,000 total denier or more. In some embodiments, a tow band may include about 50,000 total denier or more. In some embodiments, a tow band may include about 60,000 total denier or more. In some embodiments, the tow band may include filaments in a range from 40,000 total denier to 100,000 total denier, e.g., from 40,000 total denier to 90,000 total denier, from 50,000 total denier to 80,000 total denier, or from 60,000 total denier to 70,000 total denier. In terms of lower limits, the tow band may include greater than 40,000 total denier, e.g., greater than 50,000 total denier, greater than 60,000 total denier, or greater than 70,000 total denier. In terms of upper limits, the tow band may include less than 100,000 total denier, e.g., less than 90,000 total denier, less than 80,000 total denier, or less than 60,000 total denier.

In some embodiments of the present disclosure, a tow band, e.g., a cellulose acetate tow band, may comprise about 3 dpf to 12 dpf and about 40,000 total denier to 100,000 total denier. In one embodiment, the cellulose acetate tow band may comprise about 3 dpf to 6 dpf and about 50,000 total denier to about 100,000 total denier. In another embodiment, the cellulose acetate tow band may comprise about 6 dpf to 12 dpf and about 40,000 total denier to about 90,000 total denier.

In some embodiments of the present disclosure, a tow band may comprise more than one type of filament. In some embodiments, the more than one type of filament may vary based on dpf, cross-sectional shape, composition, treatment prior to forming the tow band, or any combination thereof. Examples of suitable additional filaments may include, but are not limited to, carbon filaments, activated carbon filaments, natural fibers, synthetic filaments, cellulose acetate filaments with a denier per filament of less than about 10, or any combination thereof.

Some embodiments of the present disclosure may include crimping the tow band to form a crimped tow band. Crimping the tow band may involve using any suitable crimping technique known to those skilled in the art. These techniques may include a variety of apparatuses including, but not limited to, a stuffer box or a gear. Non-limiting examples of crimping apparatuses and the mechanisms by which they work can be found in U.S. Pat. Nos. 7,610,852 and 7,585,441, the relevant disclosures of which are incorporated herein by reference. Suitable stuffer box crimpers may have smooth crimper nip rolls, threaded or grooved crimper nip rolls, textured crimper nip rolls, upper flaps, lower flaps, or any combination thereof.

In some embodiments, the crimp may also be characterized by the uncrimping energy (UCE) and breaking strength (B S). As used herein, "UCE" is the amount of work required to uncrimp a tow band. UCE is the area under the load-elongation curve between defined load limits, per unit length of extended sample (at the upper load limit). The BS is taken at the highest load point of the stress-strain curve and calculated, taking into account the double thickness of the tow. The tow must meet minimum strength requirements so that it can process through a rodmaker without breaking. Generally, UCE and BS can be measured as follows:

preconditioning the tow band sample (24 hours at 22° C.+/−2° C. with relative humidity at 60%+/−2%), pre-cutting the tow band sample, warming (about 20 minutes before conventional calibration) Instron tensile tester (Model 1130, crosshead gears—Gear #'s R1940-1 and R940-2, Instron Series IX-Version 6 data acquisition & analysis software, Instron 50 Kg maximum capacity load cell, Instron top roller assembly, 1"×4"×⅛" thick high grade non-slip grip faces), loading the preconditioned tow band sample (about a 76 cm length is looped over and spread evenly across the center of the top roller), pre-tensioning the tow band (gently pulling to 100 g+/−2 g per readout display), clamping each end of the sample in the lower of the non-slip grips to effect a 50 cm gauge length (clamping at the highest available pressure, but not exceeding the manufacturers recommendations) (gauge length measured from top of the non-slip grips), and testing at a crosshead speed of 30 cm/minute until breaking the tow band (Instron, Model 1130).

The average of at least three data points provides UCE as calculated by Formula I:

$$\text{UCE (gcm/cm)}=(E*1000)/((D*2)+500), \qquad \text{Formula I:}$$

where (E) is the energy (g-cm) between load limits of 0.220 kg and 10 kg, (D) is displacement in units of mm at present point (10.0 kg), (2) is a multiplier to adjust for a doubled sample, and (500) is the original gage length (mm).

The breaking strength (BS) can be calculated according to Formula II:

$$BS=L, \qquad \text{Formula II:}$$

where (L) is the load measured at maximum load (kg).

When measured after baling, the UCE may range from a lower limit of about 150 gcm/cm, 200 gcm/cm, 250 gcm/cm, or 300 gcm/cm to an upper limit of about 400 gcm/cm, 350 gcm/cm, 300 gcm/cm, or 250 gcm/cm, and wherein the UCE may range from any lower limit to any upper limit and encompass any subset therebetween.

It was surprisingly found that the high total denier cellulose acetate tow exhibited increased breaking strength while maintaining or increasing UCE. For example, with the same denier per filament, high total denier cellulose acetate tow exhibited an increased breaking strength compared to low or medium (less than 40,000 total denier) total denier cellulose acetate tow.

The configuration of the crimp may play a role in the processability of the final bale. Examples of crimp configurations may include, but not be limited to, lateral, vertical, some degree between lateral and vertical, random, or any combination thereof. As used herein, the term "lateral" when describing crimp orientation refers to crimp or fiber bends in the plane of the tow band. As used herein, the term "vertical" when describing a crimp orientation refers to crimp projecting outside of the plane of the tow band and perpendicular to the plane of the tow band. It should be noted that the terms lateral and vertical refer to general overall crimp orientation and may have deviation from said configuration by ±30 degrees.

In some embodiments of the present disclosure, a crimped tow band may comprise filaments with a first crimp configuration and filaments with a second crimp configuration.

In some embodiments of the present disclosure, a crimped tow band may comprise filaments with at least a vertical crimp configuration near the edges and filaments with at least a lateral crimp configuration near the center. In some embodiments, a crimped tow band may comprise filaments with a vertical crimp configuration near the edges and filaments with a lateral crimp configuration near the center.

The configuration of the crimp may be important for the processability of the final bale in subsequent processing steps, e.g., a lateral crimp configuration may provide better cohesion of filaments than a vertical crimp configuration unless further steps are taken to enhance cohesion. To achieve a lateral crimp, at least one of three processing parameters may be manipulated, e.g., the water content of the tow band prior to crimping, the thickness of the tow band during crimping, and the nip to flap force ratio during crimping.

In some embodiments of the present disclosure, the filaments may be adhered to each other to provide better processability of the final bale. While adhesion additives may be used in conjunction with any crimp configuration, it may be advantageous to use adhesion additives with a vertical crimp configuration. In some embodiments, adhering may involve adhesion additives on and/or in the filaments. Examples of such adhesion additives may include, but not be limited to, binders, adhesives, resins, tackifiers, or any combination thereof. It should be noted that any additive described herein, or otherwise, capable of adhering two filaments together may be used, which may include, but not be limited to, active particles, active compounds, ionic resins, zeolites, nanoparticles, ceramic particles, softening agents, plasticizers, pigments, dyes, flavorants, aromas, controlled release vesicles, surface modification agents, lubricating agents, emulsifiers, vitamins, peroxides, biocides, antifungals, antimicrobials, antistatic agents, flame retardants, antifoaming agents, degradation agents, conductivity modifying agents, stabilizing agents, or any combination thereof. Some embodiments of the present disclosure may involve adding adhesive additives to the filaments (m, on, or both) by incorporating the adhesive additives into the dope, incorporating the adhesive additives into the finish, applying the adhesive additives to the filaments (before, after, and/or during forming the tow band), applying the adhesive additives to the tow band (before, after, and/or during crimping), or any combination thereof.

Further, some embodiments of the present disclosure may involve heating the filaments before, after, and/or during crimping. While said heating may be used in conjunction with any crimp configuration, it may be advantageous to use said heating with a vertical crimp configuration. Said heating may involve exposing the filaments of the tow band to steam, aerosolized compounds (e.g., plasticizers), liquids, heated fluids, direct heat sources, indirect heat sources, irradiation sources that causes additives in the filaments (e.g., nanoparticles) to produce heat, or any combination thereof.

Some embodiments of the present disclosure may include conditioning the crimped tow band. Conditioning may be used to achieve a crimped tow band having a residual acetone content of 0.5% or less w/w of the crimped tow band. Conditioning may be used to achieve a crimped tow band having a residual water content of 8% or less w/w of the crimped tow band. Conditioning may involve exposing the filaments of the crimped tow band to steam, aerosolized compounds (e.g., plasticizers), liquids, heated fluids, direct heat sources, indirect heat sources, irradiation sources that causes additives in the filaments (e.g., nanoparticles) to produce heat, or any combination thereof.

Some embodiments of the present disclosure may include baling the crimped tow band to produce a bale. In some embodiments, baling may involve placing, e.g., laying, depositing, or arranging, the crimped tow band in a can in a pattern. It should be noted that can is used generically to refer to a container that may be in any shape, preferably square or rectangle, and of any material. As used herein, the term "pattern" refers to any design which may or may not change during placing. In some embodiments of the present disclosure, the pattern may be substantially zig-zag having a periodicity of about 0.5 cycles/ft to about 6 cycles/ft. In some embodiments, placing may involve puddling the crimped tow band with a puddling index of about 10 m/m to about 40 m/m. As used herein, the term "puddling" refers to allowing the tow band to lay at least partially on itself so as to place a greater actual length of tow band than linear distance on which it is placed. As used herein, the term "puddling index" refers to the length of tow band per linear distance on which it is placed.

In some embodiments of the present disclosure, baling may involve compressing the crimped tow band that has been placed in a suitable container.

In some embodiments, the bale includes a crimped tow band having from 3 dpf to 6 dpf and from 50,000 total denier to 100,000 total denier, the crimped tow band comprising a plurality of cellulose acetate filaments. In other embodiments, the bale includes a crimped tow band having from 6 dpf to 12 dpf denier per filament and from 40,000 total denier to 90,000 total denier, the crimped tow band comprising a plurality of cellulose acetate filaments. Some embodiments of the present disclosure may involve placing the crimped tow band from a bale into an apparatus so as to form a filter rod.

Hollow Filter Rods, Hollow Filters, Non-Wrapped Filter Rods, and Non-Wrapped Filters In some embodiments of the present disclosure, a bale of crimped tow band having a high total denier (as described above) may be used to form hollow filter rods, hollow filter sections, non-wrapped filter rods, and non-wrapped filters or any combination thereof that are suitable for use with smoking devices, e.g,. conventional cigarettes or aerosol-generating devices. Examples of suitable high total denier tow bands may be those according to the various embodiments disclosed herein.

In some embodiments, a bale of crimped tow band having at least 3 dpf or more and at least 50,000 total denier or more may be used in producing hollow filter rods, hollow filter sections, or any combination thereof. In some embodiments, a bale of crimped tow band having at least 6 dpf or more and at least 40,000 total denier or more may be used in producing hollow filter rods, hollow filter sections, or any combination thereof. In some embodiments, a bale of crimped tow band having from 3 dpf to 6 dpf and from 50,000 total denier to 100,000 total denier may be used in producing hollow filter rods, hollow filter sections, or any combination thereof. In some embodiments, a bale of crimped tow band having from 6 dpf to 12 dpf and from 40,000 total denier to 90,000 total denier may be used in producing hollow filter rods, hollow filter sections, or any combination thereof. In some embodiments, the bale of crimped tow band having a high total denier comprises a hollow cellulose acetate tow to form filter rods, filter sections, or combinations thereof. In some aspects, the cellulose acetate tow may be a non-wrapped cellulose acetate tow.

In one aspect, the filter rod may comprise a hollow cellulose acetate tube comprising at least 3 denier per filament and at least 50,000 total denier. For example, the filter rod may comprise a hollow cellulose acetate tube comprising 6 denier per filament and 50,000 total denier. In another aspect, the filter rod may comprise a hollow cellulose acetate tube comprising at least 6 denier per filament and at least 40,000 total denier. For example, the he filter rod may comprise a hollow cellulose acetate tube comprising at least 8 denier per filament and at least 40,000 total denier. The hollow cellulose acetate tube may be a non-wrapped cellulose acetate. The filter rod may have a cross-sectional shape selected from the group comprising circular, substantially circular, crenulated, ovular, substantially ovular, polygonal, substantially polygonal, dog-bone, "Y," "X," "K," "C," multi-lobe, and any combination thereof. In some aspects, the filter rod cross-section is a Y-shaped. In another aspect, the filter rod cross-section is substantially circular.

In some embodiments, a bale of crimped tow band having at least 3 dpf or more and at least 50,000 total denier or more may be used in producing non-wrapped filter rods, non-wrapped filter sections, or any combination thereof. In some embodiments, a bale of crimped tow band having at least 6 dpf or more and at least 40,000 total denier or more may be used in producing non-wrapped filter rods, non-wrapped filter sections, or any combination thereof. In some embodiments, a bale of crimped tow band having from 3 dpf to 6 dpf and from 50,000 total denier to 100,000 total denier may be used in producing non-wrapped filter rods, non-wrapped filter sections, or any combination thereof. In some embodiments, a bale of crimped tow band having from 6 dpf to 12 dpf and from 40,000 total denier to 90,000 total denier may be used in producing non-wrapped filter rods, non-wrapped filter sections, or any combination thereof. In some embodiments, the bale of crimped tow band having a high total denier comprises a hollow cellulose acetate tow to form non-wrapped filter rods, non-wrapped filter sections, or combinations thereof. In some aspects, the cellulose acetate tow may be a non-wrapped, hollow cellulose acetate tow.

The cellulose acetate tow described herein may be prepared as a filter rod to be used as a cellulose acetate tow filter in a smoking device. The method for forming the filter may include feeding a tow band (crimped or otherwise) having at least 3 dpf and at least 50,000 total denier, or a tow band (crimped or otherwise) having at least 6 dpf and at least 40,000 total denier, from a bale into an apparatus capable of producing filter rods. In some embodiments, producing a filter rod may include several steps including, but not limited to, at least one of the following: blooming the crimped tow band into a bloomed tow band; optionally treating the bloomed tow band with an additive; channeling the bloomed tow band yielding a continuous tow cable; wrapping a continuous tow cable with a paper yielding a wrapped tow rod; or alternatively omitting the wrapping step to yield an un-wrapped tow rod; adhering the paper of a wrapped tow rod yielding a filter rod length; cutting the filter rod length into filter rods, filters, and/or filter sections; or any combination thereof. In some embodiments, producing filters and/or filter sections may involve cutting filter rod lengths or filter rods. In some embodiments, producing filter sections may involve cutting filter rod lengths, filter rods, or filters. The filter rod lengths, filter rods, and/or filter sections may have any cross-sectional shape including, but not limited to, circular, substantially circular, ovular, substantially ovular, polygonal (including those with rounded corners), or any hybrid thereof.

Some embodiments of the present disclosure may involve treating the bloomed tow band with additives, at least once. In some embodiments, treating may occur while the bloomed tow band has a large edge-to-edge width and/or while channeling the bloomed tow band. It may be advantageous, but not required, that when the additive is in a particulate form, said treating occurs during channeling. It should be noted that treating may be done by any method including, but not limited to, applying, dipping, immersing, submerging, soaking, rinsing, washing, painting, coating, showering, drizzling, spraying, placing, dusting, sprinkling, affixing, or any combination thereof.

Suitable additives may be those delineated above including, but not limited to, active particles, active compounds, ion exchange resins, zeolites, nanoparticles, ceramic particles, softening agents, plasticizers, pigments, dyes, flavorants, aromas, controlled release vesicles, binders, adhesives, tackifiers, surface modification agents, lubricating agents, emulsifiers, vitamins, peroxides, biocides, antifungals, antimicrobials, antistatic agents, flame retardants, antifoaming agents, degradation agents, conductivity modifying agents, stabilizing agents, and any combination thereof.

In some embodiments of the present disclosure, additives, e.g., active particles and/or active compounds, may be capable of reducing and/or removing a smoke stream component from a smoke stream. One skilled in the art, with the benefit of this disclosure should understand that a smoke stream may be interchanged with a fluid stream for other filter applications. Examples of smoke stream components may include, but not be limited to, acetaldehyde, acetamide, acetone, acrolein, acrylamide, acrylonitrile, aflatoxin B-1,4-aminobiphenyl, 1-aminonaphthalene, 2-aminonaphthalene, ammonia, ammonium salts, anabasine, anatabine, 0-anisidine, arsenic, A-α-C, benz[a]anthracene, benz[b]fluoroanthene, benz[j]aceanthrylene, benz[k]fluoroanthene, benzene, benzo[b]furan, benzo[a]pyrene, benzo[c]phenanthrene, beryllium, 1,3-butadiene, butyraldehyde, cadmium, caffeic acid, carbon monoxide, catechol, chlorinated dioxins/furans, chromium, chrysene, cobalt, coumarin, a cresol, crotonaldehyde, cyclopenta[c,d]pyrene, dibenz(a,h)acridine, dibenz(a,j)acridine, dibenz[a,h]anthracene, dibenzo(c,g)carbazole, dibenzo[a,e]pyrene, dibenzo[a,h]pyrene, dibenzo[a,i]pyrene, dibenzo[a,l]pyrene, 2,6-dimethylaniline, ethyl carbamate (urethane), ethylbenzene, ethylene oxide, eugenol, formaldehyde, furan, glu-P-1, glu-P-2, hydrazine, hydrogen cyanide, hydroquinone, indeno[1,2,3-cd]pyrene, IQ, isoprene, lead, MeA-α-C, mercury, methyl ethyl ketone, 5-methylchrysene, 4-(methylnitrosamino)-1-(3-pyridyl)-1-butanone (NNK), 4-(methylnitrosamino)-1-(3-pyridyl)-1-butanol (NNAL), naphthalene, nickel, nicotine, nitrate, nitric oxide, a nitrogen oxide, nitrite, nitrobenzene, nitromethane, 2-nitropropane, N-nitrosoanabasine (NAB), N-nitrosodiethanolamine (NDELA), N-nitrosodiethylamine, N-nitrosodimethylamine (NDMA), N-nitrosoethylmethylamine, N-nitrosomorpholine (NMOR), N-nitrosonornicotine (NNN), N-nitrosopiperidine (NPIP), N-nitrosopyrrolidine (NPYR), N-nitrososarcosine (NSAR), phenol, PhIP, polonium-210 (radio-isotope), propionaldehyde, propylene oxide, pyridine, quinoline, resorcinol, selenium, styrene, tar, 2-toluidine, toluene, Trp-P-1, Trp-P-2, uranium-235 (radio-isotope), uranium-238 (radio-isotope), vinyl acetate, vinyl chloride, or any combination thereof. In some embodiments of the present disclosure, additives may be capable of reducing and/or removing a component from a fluid stream. Suitable components may include, but not be limited to, dust particulates, pollen, mold, bacteria, ozone, and the like, or any combination thereof.

In some embodiments, when wrapped, suitable papers may include, but not be limited to, tipping papers, plug wrap papers, tipping base papers, wood-based papers, paper containing flaxs, flax papers, functionalized papers, special marking papers, colorized papers, high porosity papers, corrugated papers, high surface strength papers, or any combination thereof. One skilled in the art, with the benefit of this disclosure, should recognize that the paper may be substituted with any known sheet material. In some embodiments, papers may comprise additives, sizings, printability agents, or any combination thereof. In some embodiments, the filter is a non-wrapped cellulose acetate filter. Some embodiments of the present disclosure may involve adhering the paper of a wrapped tow rod yielding a filter rod length. Adhering may be achieved with any known adhesive capable of adhesively securing the paper wrapped about the tow rod.

Some embodiments of the present disclosure may involve cutting the filter rod length into filter rods and/or filter sections. Cutting may involve any known method and/or apparatus of cutting. The length of a filter rod may range from a lower limit of about 50 mm, 75 mm, or 100 mm to an upper limit of about 150 mm, 140 mm, 130 mm, 120 mm, 110 mm, or 100 mm, and wherein the length may range from any lower limit to any upper limit and encompass any subset therebetween. The length of a filter may range from a lower limit of about 20 mm, 25 mm, or 30 mm to an upper limit of about 50 mm, 45 mm, or 40 mm, and wherein the length may range from any lower limit to any upper limit and encompass any subset therebetween. The length of a filter section may range from a lower limit of about 3 mm, 4 mm, or 5 mm to an upper limit of about 15 mm, 14 mm, 13 mm, 12 mm, 11 mm, or 10 mm, and wherein the length may range from any lower limit to any upper limit and encompass any subset therebetween.

Some embodiments of the present disclosure may involve connecting at least two filter sections. Some embodiments may involve connecting at least two filter sections in fluid communication with each other. Connecting may include, but not be limited to, joining, attaching, combining, associating, coupling, or the like. In some embodiments, connecting may be end-to-end along the longitudinal axis of the filter sections. In some embodiments, connecting at least two filter sections may form a sectioned filter and/or a sectioned filter rod. Some embodiments may involve providing at least two filter sections in respective containers, e.g., hoppers, crates, boxes, drums, bags, or cartons, before connecting. Some embodiments may comprise feeding the at least two filter sections into a row wherein the sections are alternated. Some embodiments may involve wrapping the at least two filter sections with a paper to form a segmented filter and/or a segmented filter rod. Some embodiments may involve transporting the segmented filter and/or the segmented filter rod for storage or use.

In some embodiments, a filter may be a sectioned filter. Some embodiments may involve sectioned filter where at least one first section is a filter section described herein and at least one second filter section may include, but not be limited, cavities, porous masses, polypropylene, polyethylene, polyolefin tow, polypropylene tow, polyethylene terephthalate, polybutylene terephthalate, random oriented acetate, papers, corrugated papers, concentric filters, carbon-on-tow, silica, magnesium silicate, zeolites, molecular sieves, salts, catalysts, sodium chloride, nylon, flavorants, tobacco, capsules, cellulose, cellulosic derivatives, cellulose acetate, catalytic converters, iodine pentoxide, coarse powders, carbon particles, carbon fibers, fibers, glass beads, nanoparticles, void chambers, baffled void chambers, or any combination thereof. It should be noted, that first and second are used for clarity in the description and do not imply any order or positional relationship. In some embodiments, the second filter section may be a cellulose acetate filter section having a different EPD than the first filter section. In some embodiments, the first filter section and the second filter section may be different filter sections described herein, e.g., different additives, different additive concentrations, different EPD, different total denier, different dpf, or any combination thereof.

In some embodiments of the present disclosure, filter rods, filters, filter sections, sectioned filters, and/or sectioned filter rods may comprise at least one cavity. In some embodiments, a cavity may be between two filter sections. The cavity may be filled with a variety of substances including, but not limited to, additives, granulated carbon, flavorants, catalysts, molecular sieves, zeolites, or any combination thereof. The cavity may contain a capsule, e.g., a polymeric capsule, that itself contains a flavorant or catalyst. The cavity, in some embodiments, may also contain a molecular sieve that reacts with selected components in the smoke to remove or reduce the concentration of the components without adversely affecting desirable flavor constituents of the smoke. In some embodiments, the cavity may include tobacco as an additional flavorant. It should be noted that a cavity insufficiently filled with a chosen substance may lack sufficient interaction between the components of the mainstream smoke and the substance in the cavity.

Some embodiments of the present disclosure may involve operably connecting filter rods, filters, filter sections, sectioned filters, and/or sectioned filter rods to a smokeable substance. Some embodiments may involve connecting filter rods, filters, filter sections, sectioned filters, and/or sectioned filter rods to a smokeable substance such that the filter rods, filters, filter sections, sectioned filters, and/or sectioned filter rods are in fluid communication with the smokeable substance.

In some embodiments of the present disclosure, a filter rod, a filter, a filter section, a sectioned filter, and/or a sectioned filter rod may be in fluid communication with a smokeable substance. In some embodiments, a smoking device may comprise a filter rod, a filter, a filter section, a sectioned filter, and/or a sectioned filter rod in fluid communication with a smokeable substance. In some embodiments of the present disclosure, a smoking device may comprise a housing operably capable of maintaining a filter rod, a filter, a filter section, a sectioned filter, and/or a sectioned filter rod in fluid communication with a smokeable substance. In some embodiments, filter rods, filters, filter sections, sectioned filters, and/or sectioned filter rods may be removable, replaceable, and/or disposable from the housing.

In some embodiments, a filter may include a tow having from 3 dpf to 6 dpf and from 50,000 total denier to 100,000 total denier, the tow comprising a plurality of cellulose acetate filaments. The filter may have an encapsulated pressure drop of about 4.5 mm water/mm length of filter or less and have a circumference of about 26 mm or less, e.g., from 18 mm to 26 mm. In some embodiments, the filter may have a circumference in a range from 18 mm to 26 mm, e.g., from 21 mm to 25 mm or from 22 mm to 24 mm. In other embodiments, the filter may further comprise additives.

In some embodiments, a filter may include a tow having from 6 dpf to 12 dpf and from 40,000 total denier to 90,000 total denier, the tow comprising a plurality of cellulose acetate filaments. The filter may have an encapsulated pressure drop of about 3.0 mm water/mm length of filter or less, and the filter may have a circumference of about 26 mm or less, e.g., 18 mm to 26 mm. In some embodiments, the filter may have a circumference in a range from 18 mm to 26 mm, e.g., from 21 mm to 25 mm or from 22 mm to 24 mm. In other embodiments, the filter may further comprise additives.

Smoking Device

In some embodiments of the present disclosure, a smoking device may comprise any of the filter rods, filters, filter sections, sectioned filters, and/or sectioned filter rods (collectively "filter components") mentioned above comprising the high total denier cellulose acetate. The high total denier filter components may be in fluid communication with a smokeable substance. In some embodiments, a smoking device may comprise a housing operably capable of maintaining a filter rod, a filter, a filter section, a sectioned filter, and/or a sectioned filter rod in fluid communication with a smokeable substance. In some embodiments, filter rods, filters, filter sections, sectioned filters, and/or sectioned filter rods may be removable, replaceable, and/or disposable from the housing.

In some embodiments, the smoking device includes a smokeable substance and a filter. The filter may comprise a cellulose acetate tow having at least 3 denier per filament and at least 50,000 total denier. In other embodiments, the filter may comprise a cellulose acetate tow having at least 6 dpf and at least 40,000 total denier. In other embodiments, the filter may comprise a cellulose acetate tow having from 3 to 6 denier per filament and from 50,000 to 100,000 total denier. In other embodiments, the filter may comprise a cellulose acetate tow having from 6 dpf to 12 dpf and from 40,000 total denier to 90,000 total denier. In some embodiments, the filter comprises a hollow cellulose acetate tube. In some embodiments, the filter comprises a non-wrapped cellulose acetate having a substantially circular cross-section.

As used herein, the term "smokeable substance" refers to a material capable of producing smoke when burned or heated. Suitable smokeable substances may include, but not be limited to, tobaccos, e.g., bright leaf tobacco, Oriental tobacco, Turkish tobacco, Cavendish tobacco, corojo tobacco, criollo tobacco, Perique tobacco, shade tobacco, white burley tobacco, flue-cured tobacco, Burley tobacco, Maryland tobacco, Virginia tobacco; teas; herbs; carbonized or pyrolyzed components; inorganic filler components; or any combination thereof. Tobacco may have the form of tobacco laminae in cut filler form, processed tobacco stems, reconstituted tobacco filler, volume expanded tobacco filler, or the like. Tobacco, and other grown smokeable substances, may be grown in the United States, or may be grown in a jurisdiction outside the United States.

In some embodiments, a smokeable substance may be in a column format, e.g., a tobacco column. As used herein, the term "tobacco column" refers to the blend of tobacco, and optionally other ingredients and flavorants that may be combined to produce a tobacco-based smokeable article, such as a cigarette or cigar. In some embodiments, the tobacco column may comprise ingredients selected from the group consisting of: tobacco, sugar (such as sucrose, brown sugar, invert sugar, or high fructose corn syrup), propylene glycol, glycerol, cocoa, cocoa products, carob bean gums, carob bean extracts, and any combination thereof. In still other embodiments, the tobacco column may further comprise flavorants, aromas, menthol, licorice extract, diammonium phosphate, ammonium hydroxide, and any combination thereof. In some embodiments, tobacco columns may comprise additives. In some embodiments, tobacco columns may comprise at least one bendable element.

Suitable housings may include, but not be limited to, cigarette, cigarette holder, cigars, cigar holders, pipes, water pipes, hookahs, electronic smoking devices, roll-your-own cigarettes, roll-your-own cigars, papers, or any combination thereof.

In some embodiments of the present disclosure, filter rods, filters, filter sections, sectioned filters, and/or sectioned filter rods may be degradable over time either naturally or in the presence of a catalyst. As used herein, the term "degradable" refers to the ability to decompose when exposed to an outdoor environment (i.e., exposed to rain, dew, or other sources of water). The degree of degradation is, at a minimum, sufficient to convert the cellulose acetate into cellulose and, at a maximum, sufficient to convert the cellulose acetate into glucose. In some embodiments, degradation may occur over at least 1 month, about 6 months or less, about 2 years or less, or about 5 years or less. One skilled in the art with the benefit of this disclosure should understand that the environmental condition, e.g., exposure to light and relative humidity, and the additives, e.g., catalysts, of the filter rods, filters, filter sections, sectioned filters, and/or sectioned filter rods will affect the rate of degradation. In some embodiments of the present disclosure, the filter rods, filters, filter sections, sectioned filters, and/or sectioned filter rods may be recycleable.

Because it is expected that a consumer will smoke a smoking device that includes a filter rod, a filter, a filter section, a sectioned filter, and/or a sectioned filter rod according to any embodiment described herein, the present disclosure also provides methods of smoking such a smoking device. For example, in one embodiment, the present disclosure provides a method of smoking a smoking device comprising: heating or lighting a smoking device to form smoke, the smoking device comprising a filter rod, a filter, a filter section, a sectioned filter, and/or a sectioned filter rod according to any embodiment described herein; and drawing the smoke through the smoking device, wherein the filter rod, the filter, the filter section, the sectioned filter, and/or the sectioned filter rod reduces the presence of at least one component in the smoke stream. In some embodiments, the smoking device is a cigarette. In other embodiments, the smoking device is a cigar, a pipe, a water pipe, a hookah, an electronic smoking device, a smokeless smoking device, a roll-your-own cigarette, a roll-your-own cigar, or another smoking device.

Some embodiments of the present disclosure may include a smoking device that includes a smokeable substance; and a filter comprising a tow having from 3 dpf to 6 dpf and from 50,000 total denier to 100,000 total denier, the tow comprising a plurality of cellulose acetate filaments. The filter may generally have an encapsulated pressure drop of 4.5 mm water/mm length of filter or less and have a circumference of about 26 mm or less, e.g., 18 mm to 26 mm. In some aspects, the circumference may be in a range from 18 mm to 26 mm, e.g., from 21 mm to 25 mm or from 22 mm to 24 mm. In some aspects, the encapsulated pressure drop may be less than 4.5 mm water/mm length of filter, less than 4 mm water/mm length of filter, or less than 3 mm water/mm length of filter.

Some embodiments of the present disclosure may include a smoking device that includes a smokeable substance and a filter comprising a tow having from 6 dpf to 12 dpf and from 40,000 total denier to 90,000 total denier, the tow comprising a plurality of cellulose acetate filaments. The filter may generally have an encapsulated pressure drop of 3 mm water/mm length of filter or less and have a circumference of about 26 mm or less, e.g., 18 mm to 26 mm. In some aspects, the circumference may be in a range from 18 mm to 26 mm, e.g., from 21 mm to 25 mm or from 22 mm to 24 mm. In some aspects, the encapsulated pressure drop may be less than 3 mm water/mm length of filter or less than 1.75 mm water/mm length of filter. In some embodiments, the cellulose acetate tow is formed into a non-wrapped cellulose acetate filter. In some embodiments, the cellulose acetate tow is formed into a hollow cellulose acetate filter.

Aerosol-Generating Device

In some embodiments, the present disclosure is directed to aerosol-generating devices comprising a hollow filter, a non-wrapped filter, or combinations thereof. The aerosol-generating device may comprise an outer casing, a reservoir having an aerosol-forming material, a mouthpiece in fluid communication with the reservoir, and a power source/heating means surrounding the reservoir. In some embodiments, the mouthpiece and/or the reservoir may comprise a cellulose acetate filter. In some embodiments, the cellulose acetate filter may comprise a hollow filter, a non-wrapped filter, or combinations thereof.

In one embodiment, the present disclosure relates to aerosol-generating articles that use electrical energy to form an inhalable substance. The aerosol-generating articles can be arranged so as to provide one or more substances (e.g., flavors and/or tobacco) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of this disclosure, the following embodiment is discussed as an example of an aerosol-generating device incorporating a high total denier cellulose acetate filter. The high total denier cellulose acetate filter may comprise a hollow filter, a non-wrapped filter, or combinations thereof. The high total denier cellulose acetate filter can be provided be provided in any configuration in the aerosol-generating device, and is not limited to the embodiments discussed below.

Aerosol-generating devices are described in greater detail in U.S. Pat. Nos. 4,819,665; 5,499,636; 6,026,820; 8,881,737; 8,910,640; and 9,597,466; and U.S. Pub. Nos. 2005/0172976; 2015/0027474; 2016/0309782; and 2017/0055580; all of which are incorporated herein by reference in their entireties.

FIG. 1 illustrates a conventional aerosol-generating article 10 according to one embodiment. The aerosol-generating article 10 may comprise an outer casing 20, an air passageway 30, a mouthpiece 40, an electric power/heating source 50, and a reservoir 70 comprising aerosol-forming material 80. During use, a user inserts the mouthpiece 40 in his or her mouth, and air flows through the distal end of the aerosol-generating article 10 via the air passageway 30. The aerosol-generating article 10 may produce an aerosol from the aerosol-forming material 80 that may be derived from tobacco as well as other additives.

In some embodiments, the mouthpiece 40 and/or the reservoir 70 including the aerosol-forming material 80 comprise a cellulose acetate filter. In some embodiments, the mouthpiece 40 and/or the reservoir 70 of the aerosol-generating device includes a cellulose acetate filter comprising high total denier cellulose acetate. The cellulose acetate filter may comprise a cellulose acetate tow having at least 3 dpf and at least 50,000 total denier. In some embodiments, the cellulose acetate filter comprises a cellulose acetate tow having at least 6 dpf and at least 40,000 total denier. In some embodiments, the cellulose acetate filter comprises a cellulose acetate tow having from 3 dpf to 6 denier per filament and from 50,000 to 100,000 total denier. In other embodiments, the cellulose acetate filter comprises a cellulose acetate tow having from 6 dpf to 12 dpf and from 40,000 total denier to 90,000 total denier. In some aspects, the cellulose acetate filter comprises a hollow cellulose acetate tube. In some aspects, the cellulose acetate filter comprises a non-wrapped cellulose acetate. In some aspects, the the cellulose acetate filter comprises a non-wrapped, hollow cellulose acetate tube.

In some embodiments, the mouthpiece 40 and/or the reservoir 70 comprise a cellulose acetate filter. In some aspects, the cellulose acetate filter comprises a hollow cellulose acetate tube having at least 3 dpf and at least 50,000 total denier, or having at least 6 dpf and at least 40,000 total denier. In some embodiments, the cellulose acetate filter is a non-wrapped cellulose acetate.

In some embodiments, the aerosol-forming material 80 is located in a reservoir 70. In the embodiment illustrated in FIG. 1, aerosol-forming material 80 comprises a gathered sheet of crimped homogenized tobacco material. The crimped sheet of homogenized tobacco material may comprise an aerosol-former—such as glycerin.

The aerosol-generating article 10 illustrated in FIG. 1 is designed to engage electric power/heating source 50 in order to form inhalable aerosol. In use, the electric power/heating source 50 of the aerosol-generating article 10 heats the aerosol-forming material 80 to a sufficient temperature to volatilize compounds that are capable of forming an aerosol, which is drawn through the air passageway 30 and inhaled by the user. In use, volatile substances released from the aerosol-forming substrate 80 may optionally pass along an aerosol-cooling element towards the mouthpiece of the aerosol-generating article 10. The volatile substances may cool within the aerosol-cooling element to form an aerosol that is inhaled by the user. In some aspects, the aerosol-cooling element may comprise a cellulose acetate tow having a denier per filament of at least 3 and at least 50,000 total denier, or having a denier per filament of at least 6 and at least 40,000 total denier. In some embodiments, the aerosol-cooling element may comprise a hollow cellulose acetate filter, a non-wrapped cellulose acetate filter, or combinations thereof.

As the aerosol passes downstream thorough the aerosol-cooling element, the temperature of the aerosol can be reduced due to transfer of thermal energy from the aerosol to the aerosol-cooling element. When the aerosol enters the aerosol-cooling element, its temperature is approximately 60° C. Due to cooling within the aerosol-cooling element, the temperature of the aerosol as it exits the aerosol-cooling element is approximately 40° C.

The cellulose acetate tow described herein may be used as an aerosol-cooling element. The aerosol-cooling element refers to a component that cools the aerosol formed by volatile compounds released from the aerosol-forming substrate. The aerosol cooling element is a separate element from the mouthpiece which comprises the cellulose acetate filter, although in some aspects, the cellulose acetate tow having at least 3 dpf and at least 50,000 total denier may be used in both the filter and aerosol-cooling element. The aerosol-cooling element may have a relatively large surface area, e.g., from 300 $mm^2$ to 1000 $mm^2$ per mm length, while still achieving low pressure drop.

The aerosol-cooling element may have a thickness from 5 to 500 micrometers, e.g., from 10 to 250 micrometers. The aerosol-cooling element may comprise an outer tube or wrapper that contains or locates the longitudinally extending channels. For example, a pleated, gathered, or folded sheet material may be wrapped in a wrapper material, for example a plug wrapper, to form the aerosol-cooling element. In some embodiments, the aerosol-cooling element comprises a sheet of crimped material that is gathered into a rod-shape and bound by a wrapper, for example a wrapper of filter paper. The aerosol-cooling element may be prepared as the filter is prepared, as described above.

In some embodiments, the aerosol-cooling element is formed in the shape of a rod having a length from 7 to 28 mm. For example, an aerosol-cooling element may have a length of 18 mm. In some embodiments, the aerosol-cooling element may have a substantially circular cross-section and a diameter of 5 mm to 10 mm. For example, an aerosol-cooling element may have a diameter of 7 mm.

The cellulose acetate tow may be the sole element of the aerosol-cooling element, or it may be combined with a polylactic acid layer. In some aspects, the weight ratio of polylactic acid to cellulose acetate tow is from 10:1 to 1:10, e.g., from 5:1 to 1:5, from 3:1 to 1:3, from 1:2 to 2:1, or 1:1.

In aspects where the cellulose acetate tow having a high total denier is not used for the aerosol-cooling element, the aerosol cooling element may comprise a different polymeric material. For example, the aerosol-cooling element may comprise a polymer sheet material selected from the group consisting of polyethylene, polypropylene, polyvinylchloride, polyethylene terephthalate, polylactic acid, and cellulose acetate films or tows.

EXAMPLES

Examples 1-5: Tow for Hollow Filters

Tests were conducted to determine the UCE and breaking strength of high total denier cellulose acetate suitable for use in hollow filter rods for use in hollow filters. The samples were prepared with the cross-section, denier per filament, and total denier described below. Examples 1-5 provide high total denier hollow acetate filters made from a single bale of cellulose acetate. Table 1 shows the tow crimp level, UCE, and breaking strength high total denier tows having low total denier (Comparatives 1-4) and high total denier (Examples 1-4). Table 1 compares the UCE and Breaking Strength of low and high total denier items for different cross-sectional shapes (Y="Y" shape; R=round). The UCE was determined according to Formula 1 described above and the breaking strength was determined by Formula II described above.

TABLE 1

| | Comp. 1 | Ex. 1 | Comp. 2 | Ex. 2 | Comp. 3 | Ex. 3 | Comp. 4 | Ex. 4 |
|---|---|---|---|---|---|---|---|---|
| Cross-Section | Y | Y | Y | Y | R | R | Y | Y |
| DPF | 8.0 | 8.0 | 8.0 | 8.0 | 8.0 | 8.0 | 12.0 | 12.0 |
| Total Denier | 28,000 | 40,000 | 28,000 | 40,000 | 28,000 | 40,000 | 28,000 | 40,000 |
| UCE | 286 | 310 | 287 | 316 | 284 | 310 | 297 | 305 |
| Breaking Strength | 21.9 | 23.6 | 20.0 | 22.3 | 13.9 | 18.9 | 15.2 | 33.5 |

In these examples, it was surprisingly and unexpectedly observed that the high total denier cellulose acetate tow exhibited increased breaking strength at high crimping energy. Typically, high crimping energy (e.g., adding more crimp to the cellulose acetate fibers) reduces the breaking the strength since high UCE damages fibers. Here, Examples 1-4 surprisingly exhibited improved breaking strength at high UCE. For example, with the same denier per filament, Examples 1-4 exhibited an increased breaking strength at an increased UCE as compared to respective Comparatives 1-4.

Table 2 shows the UCE and breaking strength for tows having low total denier (Comparative 5) and high total denier (Example 5). Table 2 compares the Breaking Strength of low and high total denier items for the same cross-sectional shape (Y="Y" shape) and same dpf (8.0).

TABLE 2

| | Comp. 5 | Ex. 5 |
|---|---|---|
| Cross-Section | Y | Y |
| DPF | 8.0 | 8.0 |
| Total Denier | 28,000 | 40,000 |
| UCE | 273 | 267 |
| Breaking Strength | 23.7 | 30.9 |

Example 5 exhibited an increased breaking strength at substantially the same UCE as Comparative Example 5. That being said, Examples 1-4 demonstrate that the high total denier cellulose acetate tow beneficially maintains or further improves the breaking strength at high UCE.

Examples 6-9: Non-wrapped, Hollow Cellulose Acetate Tube

Examples 6-9 show properties of high total denier non-wrapped, hollow cellulose tow items based on dpf and cross section, compared to low/medium total denier non-wrapped, hollow cellulose tow items of Comparative 6-9. The parameters in Table 3 have the following relationships:

TD/SSA*SSAi, where

TD=total denier/1000

SSA=cross-section perimeter

SSAI=surface area index=(perimeter/area)×0.5× square root (area/3.14156).

SSA is determined as follows: [measured perimeter (micron)/measured area (micron)]×[1/density], where the density for cellulose acetate is 1.3 g/cm$^3$. SSAi is the measured perimeter of a sample (microns)/perimeter of circle of equal area. Image analysis is used to generate the quantitative data for the cross-sectional analysis with software designed to make the calculations.

TABLE 3

| | DPF/TD | TD/SSA | TD/SSA*SSAi |
|---|---|---|---|
| Example 6 | 3.4/68 | 279 | 425 |
| Example 7 | 5.0/56 | 273 | 419 |
| Example 8 | 8.0/40 | 236 | 388 |
| Example 9 | 12.0/40 | 291 | 493 |
| Comp. 6 | 3.4/34 | 139 | 212 |
| Comp. 7 | 5.0/28 | 137 | 210 |
| Comp. 8 | 8.0/28 | 165 | 271 |
| Comp. 9 | 12.0/25 | 182 | 308 |

Table 3 shows that high total denier tow items have a TD/SSA*SSAi value of greater than 350-500 compared to low/medium denier tow items at 200-350. This increased value indicates the ideal ratio of total denier (TD) and cross-section surface area to produce hollow and non-wrapped acetate filters. The combination maximizes the effect of both parameters to meet strength/hardness and pressure drop requirements.

In some embodiments, the hollow and/or non-wrapped cellulose acetate items may comprise a cellulose acetate tow having a ratio of total denier to SSA (TD/SSA) in a range from 200:1 to 360:1, e.g., from 220:1 to 340:1, from 240:1 to 320:1, from 260:1 to 300:1, or from 270:1 to 290:1. In terms of upper limits, the ratio of total denier to SSA is less than 360:1, e.g., less than 340:1, less than 320:1, or less than 300:1. In terms of lower limits, the ratio of total denier to SSA is greater than 200:1, e.g., greater than 220:1, greater than 240:1, or greater than 260:1.

In some embodiments, the hollow and/or non-wrapped cellulose acetate items may comprise a cellulose acetate tow having a ratio of total denier to SSA*SSAi (TD/SSA*SSAi) in a range from 350:1 to 550:1, e.g., from 380:1 to 520:1, from 400:1 to 500:1, from 410:1 to 490:1, or from 420:1 to 450:1. In terms of upper limits, the ratio of total denier to SSA*SSAi is less than 550:1, e.g., less than 520:1, less than 490:1, or less than 450:1. In terms of lower limits, the ratio of total denier to SSA*SSAi is greater than 350:1, e.g., greater than 380:1, greater than 410:1, or greater than 440:1.

In some embodiments, the hollow and/or non-wrapped cellulose acetate items may comprise a cellulose acetate tow having from 3 dpf to 6 dpf, from 50,000 to 100,000 total denier, and a ratio of total denier to SSA from 250:1 to 300:1. In some embodiments, the hollow and/or non-wrapped cellulose acetate items may comprise a cellulose acetate tow having from 6 dpf to 12 dpf, from 40,000 to 90,000 total denier, and a ratio of total denier to SSA from 200:1 to 300:1. In one aspect, the hollow and/or non-wrapped cellulose acetate items may comprise a cellulose acetate tow having at least 3.4 dpf, at least 68,000 total denier, and a ratio of total denier to SSA of at least 279:1. In another aspect, hollow and/or non-wrapped cellulose acetate items may comprise a cellulose acetate tow having at least 12 dpf, at least 40,000 total denier, and a ratio of total denier to SSA of at least 291:1.

In some embodiments, the hollow and/or non-wrapped cellulose acetate items may comprise a cellulose acetate tow having from 3 dpf to 6 dpf, from 50,000 to 100,000 total denier, and a ratio of total denier to SSA*SSAi from 400:1 to 150:1. In some embodiments, the hollow and/or non-wrapped cellulose acetate items may comprise a cellulose acetate tow having from 6 dpf to 12 dpf, from 40,000 to 90,000 total denier, and a ratio of total denier to SSA*SSAi from 380:1 to 500:1. In one aspect, the hollow and/or non-wrapped cellulose acetate items may comprise a cellulose acetate tow having at least 3.4 dpf, at least 68,000 total denier, and a ratio of total denier to SSA*SSAi of at least 425:1. In another aspect, hollow and/or non-wrapped cellulose acetate items may comprise a cellulose acetate tow having at least 12 dpf, at least 40,000 total denier, and a ratio of total denier to SSA*SSAi of at least 493:1.

While the invention has been described in detail, modifications within the spirit and scope of the invention will be readily apparent to those of skill in the art. It should be understood that aspects of the invention and portions of various embodiments and various features recited above and/or in the appended claims may be combined or interchanged either in whole or in part. In the foregoing descriptions of the various embodiments, those embodiments which refer to another embodiment may be appropriately combined with other embodiments as will be appreciated by one of ordinary skill in the art. Furthermore, those of ordinary skill in the art will appreciate that the foregoing description is by way of example only, and is not intended to limit the invention. All US patents and publications cited herein are incorporated by reference in their entirety.

We claim:

1. A hollow filter rod comprising a cellulose acetate tow having from 3 to 12 denier per filament and from 40,000 to 100,000 total denier, wherein the cellulose acetate tow has a UCE of at least 150 gcm/cm, wherein the cellulose acetate tow has an encapsulated pressure drop of less than 4.5 mm water/mm length.

2. The hollow filter rod of claim 1, wherein the hollow filter rod is a non-wrapped cellulose acetate filter rod.

3. The hollow filter rod of claim 1, wherein the cellulose acetate tow comprises from 3 to 6 denier per filament and greater than 50,000 to 100,000 total denier.

4. The hollow filter rod of claim 1, wherein the cellulose acetate tow comprises from 6 to 12 denier per filament and from 40,000 to 90,000 total denier.

5. The hollow filter rod of claim 1, wherein filaments of the cellulose acetate tow have a cross-sectional shape selected from the group comprising circular, substantially circular, crenulated, ovular, substantially ovular, polygonal, substantially polygonal, dog-bone, "Y," "X," "K," "C," multi-lobe, and any combination thereof.

6. A device comprising a hollow filter, the hollow filter comprising:

a cellulose acetate tow comprising at least 3 to 12 denier per filament and from 40,000 to 100,000 total denier, wherein the cellulose acetate tow has a UCE from 150 gcm/cm to 400 gcm/cm, wherein the cellulose acetate tow has an encapsulated pressure drop of less than 4.5 mm water/mm length.

7. The device of claim 6, wherein the cellulose acetate tow has from 3 to 6 denier per filament and greater than 50,000 to 100,000 total denier.

8. The device of claim 6, wherein the cellulose acetate tow comprises 50,000 to 100,000 total denier.

9. The device of claim 6, wherein the cellulose acetate tow comprises from 6 to 10 denier per filament and from 40,000 to 90,000 total denier.

10. The device of claim 6, wherein the cellulose acetate tow comprises 8 to 12 denier per filament.

11. The device of claim 6, wherein the hollow-filter is a non-wrapped cellulose acetate filter.

12. The device of claim 6, further comprising an aerosol-generating article comprising the hollow filter.

13. The hollow filter rod of claim 1, wherein the hollow filter rod is produced from a single cellulose acetate tow band.

14. The hollow filter rod of claim 1, wherein the cellulose acetate tow comprises a breaking strength from 18 N to 33 N.

15. The hollow filter rod of claim 1, wherein the cellulose acetate tow comprises a ratio of total denier to cross-section perimeter from 200:300:1.

16. The hollow filter rod of claim 1, wherein the cellulose acetate tow comprises at least 3.4 dpf, at least 68,000 total denier, and a ratio of total denier to SSA of at least 279:1.

* * * * *